US008328703B2

(12) United States Patent
Boccalini, Jr. et al.

(10) Patent No.: US 8,328,703 B2
(45) Date of Patent: Dec. 11, 2012

(54) ROLLING MILL CAST ROLL

(75) Inventors: Mario Boccalini, Jr., Sao Paulo (BR); Gilson Teixeira Cornelio, Pindamonhangaba (BR); Renato Rufino Xavier, Pindamonhangaba (BR)

(73) Assignee: Acos Villares S.A., Pinheiros, Sao Paul (BR)

( * ) Notice: Subject to any disclaimer, the term of this patent is extended or adjusted under 35 U.S.C. 154(b) by 598 days.

(21) Appl. No.: 12/474,661

(22) Filed: May 29, 2009

(65) Prior Publication Data

US 2010/0304942 A1 Dec. 2, 2010

(51) Int. Cl.
*B21B 27/02* (2006.01)

(52) U.S. Cl. ..... 492/3; 492/54; 492/58

(58) Field of Classification Search ..... 492/3, 54, 492/58; 148/331; 420/12, 40, 120
See application file for complete search history.

(56) References Cited

U.S. PATENT DOCUMENTS

| | | | | |
|---|---|---|---|---|
| 3,155,498 | A * | 11/1964 | Jandras | 148/543 |
| 3,273,998 | A * | 9/1966 | Knoth et al. | 420/17 |
| 3,998,664 | A | 12/1976 | Rote | |
| 4,040,875 | A * | 8/1977 | Noble | 148/321 |
| 4,131,456 | A | 12/1978 | Peregudov et al. | |
| 4,958,422 | A | 9/1990 | Oshima et al. | |
| 5,316,596 | A * | 5/1994 | Kataoka | 148/321 |
| 5,355,932 | A * | 10/1994 | Nawata et al. | 164/95 |
| 6,013,141 | A | 1/2000 | Nylen et al. | |
| 6,270,594 | B1 * | 8/2001 | Bodnar et al. | 148/546 |
| 8,012,410 | B2 * | 9/2011 | Shah | 420/27 |

FOREIGN PATENT DOCUMENTS

| | | |
|---|---|---|
| CN | 1179368 | 4/1998 |
| DE | 100 37 363 A1 | 2/2002 |
| DE | 69 629 720 T3 | 12/2006 |
| FR | 2 697 766 A1 | 5/1994 |
| JP | 56-041061 | 4/1981 |
| JP | 6-172927 | 6/1994 |
| JP | 8-035034 | 2/1996 |
| SE | 8 604 589 | 4/1988 |
| SU | 1 303 260 A1 | 4/1987 |
| WO | WO 95/24513 | 9/1995 |
| WO | WO 96/39544 | 12/1996 |

OTHER PUBLICATIONS

A.B. Jacuinde et al., "The wear behavior of high-chromium white cast irons as a function of silicon and Mischmetal content," Wear, 250 (2001), p. 449-461.

(Continued)

*Primary Examiner* — Sarang Afzali
(74) *Attorney, Agent, or Firm* — Nixon Peabody LLP; Jeffrey L. Costellia

(57) ABSTRACT

The rolling mill cast roll having a shield portion made of multi-component white iron with excellent resistance to adhesion and propagation of cracks, having a composition consisting essentially, by weight ratio, of 1.5-2.5% carbon, 3.0-10% chromium, 2.0-8.0% molybdenum, 2.0-8.0% tungsten, 2.0-10% vanadium, 0.1-0.8% sulfur, up to 2.0% manganese, wherein the manganese is balanced with said sulfur in a 2:1 ratio (Mn:S), up to 1.0% silicon, up to 1.0% of nickel, 0.1% Ce, up to 0.08% phosphorus and a sufficient amount of Fe, is produced by a centrifugal casting method.

2 Claims, 1 Drawing Sheet

OTHER PUBLICATIONS

M. Boccalini Jr. et al., "Rare earth metal induced modification of $\gamma$-$M_2C$, $\gamma$-$M_6C$, and $\gamma$-MC eutectics in as cast M2 high speed steel," Material Science and Technology, vol. 15, Jun. 1999, p. 621-622.

K. Peev et al., "Modification of Fe-Cr-C alloys using mischmetal," Journal of Materials Science Letters , vol. 13, 1994, p. 112-114.

Y. Tamura et al., "Influence of the Addition of REM and Alloying elements on the behavior of MC carbide formation during solidification of 32V High Speed Tool Steels," Proceeding of the Sixth International Iron and Steel Congress, Iron and Steel Institute of Japan, 1990, Nagoya, p. 649-650.

Office Action dated Sep. 8, 2011 issued by an Italian Patent Office in Italian Patent App. No. IT MI 2009 0945.

Search Report and Written Opinion issued in Italian Patent App. No. IT MI 2009 0945, Application filed on May 28, 2009.

Office Action mailed Sep. 30, 2011 issued by a Malaysian Patent Office in Malaysian Patent App. No. PI 2009 2220.

English-language translation of an Office Action dated Mar. 24, 2011 issued by Swedish Patent Office in Swedish Patent App. No. 0950380-6.

English-language translation summary of Office Action dated Dec. 6, 2011 issued by Thailand Patent Office in Thailand Patent App. No. 090 100 2404.

B.I. Voronenko,"Compositions and Heat Treatment of Modern Roll Steels," Structural Steels, vol. 37, Nos. 11-12., 1995, p. 450-456.

Favorable Technical Opinion dated Feb. 19, 2010 issued by Austrian Patent Office.

* cited by examiner

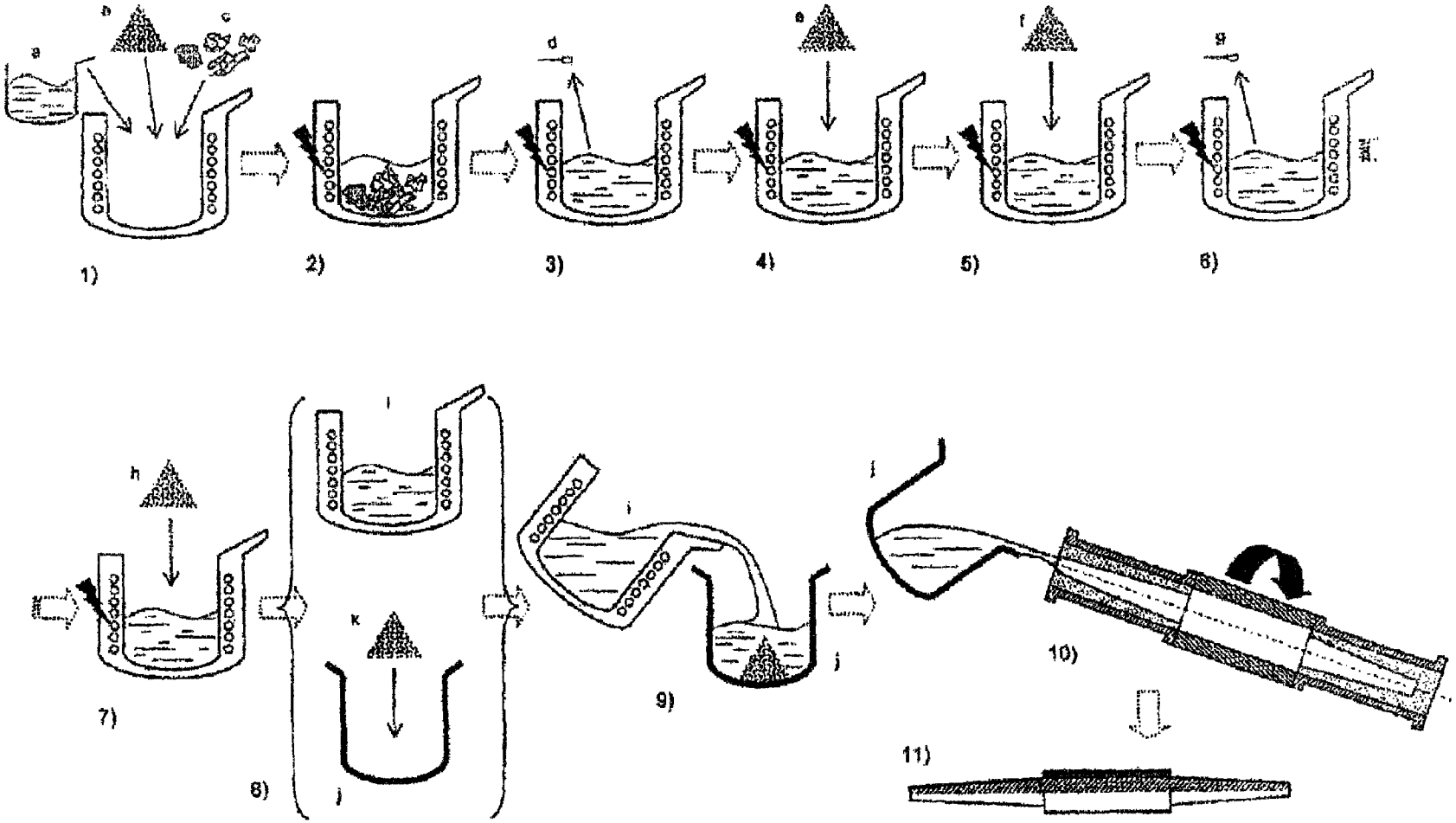
1)
2)
3)
4)
5)
6)
7)
8)
9)
10)
11)

ROLLING MILL CAST ROLL

BACKGROUND OF THE INVENTION

1. Field of the Invention

The present invention is directed to a process for the production of highly degradation resistant rolling mill cast rolls as well as to the rolls produced through this process.

2. Background Art

As is known by those skilled in the art, the rolling mill rolls are tools used in the rolling process, by means of which plain or long metallic material products are shaped, predominantly steels. Like any shaping tool, it is the rolling mill roll that contacts directly the shaped product, thus leading to the continuous and increasing degradation of the surface thereof during its use as well as the consequent need to recover the initial condition of this surface after a certain period of use. Such recovery is carried out by removing the deteriorated surface layer through machining, thus requiring the shutdown of the rolling mill to extract the degraded roll and replace same with a new or already repaired roll.

Therefore, the quality and the productivity of the rolling process are intimately connected to the service performance of the rolling mill rolls, since:

(a) the quality of rolled products is mainly determined by the precision and repeatability of the shape thereof, that reflect directly the geometry and the condition of the surface of the rolls;

(b) the productivity of the rolling mill is determined in part by the uninterrupted service time that the rolling mill roll can withstand, keeping the quality of the rolled product above the minimum level set (the minimization of the shutdowns to exchange the rolls, made possible by rolls that are more resistant to degradation, implying directly in the increase of the productivity of the production line.

In the final phase of the process of hot-rolling strips, a set of in line rolling modules ("roll stands") that is called finishing train is used. The amount of roll stands may vary as a function of the design and the conception of the rolling mill itself.

As there is a difference of degradation factors between the first roll stand and the last roll stand, different materials of rolls are also used.

The degradation of the rolling mill rolls happens to be a process characterized by the simultaneous action of distinct wear modes: abrasion, oxidation, adhesion and thermal fatigue. However, it is known that one or two of such wear modes in each roll stand of the rolling mill train are predominant: in the first roll stand, where the shaping takes place at temperatures of the order of 1,000° C., the thermal fatigue and oxidation phenomena act more intensely; in the last roll stand, where the shaping takes place at temperatures of the order of 700° C., the abrasion and adhesion are predominant.

Another drawback found in the finishing train provided with traditional rolls is the fact that, together with the gradual degradation of the surface of the rolling mill roll, unforeseen damages caused by operational incidents of the finishing train, such as the adhesion of the rolled strip on the roll ("sticking" or "welding") and the unstable propagation of surface or subsurface cracks on the roll, cause the shutdown of the operation of the rolling mill for removing the roll. Two operational characteristics of the last roll stands of the finishing train make the rolls that work thereon more susceptible to such damages:

(a) low rolling temperature (that determines the low kinetics of the oxide formation on the surface of the roll, what compromises the performance thereof as a protection against the adhesion);

(b) little thickness of the rolled strip.

The rolling mill rolls designed to the finishing trains, in most of the cases, are bimetallic cast components that are comprised of an "external shield" made of a wear resistant alloy and a "core" made of nodular or gray cast iron. The process that is commonly used for the production of such bimetallic rolls is centrifuged casting in a metallic mold: the material of the shield is poured into the mold and, due to the action of the centrifugal force, it is distributed uniformly over its inner surface, forming an outer layer (or shield) with a thickness between 40 and 120 mm; after the solidification of the shield, the material of the core is poured into the same mold still rotating, thus filling up same. When in contact with the inner surface of the already solidified shield, the material of the core recasts a low volume of the shield (about 10 mm along the whole inner surface thereof), thus creating a metallurgical link between the shield and core that is called interface.

For the first roll stands, where the oxidation and thermal fatigue factors are predominant, rolls with a working layer (shield) made of white high-chromium cast iron are prevalent, as well as multi-component white cast irons, also called high-speed steels; therefore, such rolls have a service performance of the order of at least twice the one observed for the chilled cast iron that is usually used in the last roll stands, where the abrasion and adhesion factors predominate, and the strip adhesion phenomenon is frequent too.

Thus, another disadvantage found in the finishing trains (last roll stands) provided with traditional rolls is a disparity of the need to exchange rolls between the first roll stand and the last roll stand, thus compromising a possible prolongation of the working time, and it is clear that if said disparity could be favorably eliminated the number of roll exchanges of the last roll stands would be reduced and the productivity of the rolling mill would be increased.

While the development of alloys for the shield of rolls designed to the first roll stands of the finishing train has been intense in last the 20 years, in the shield of rolls designed to the last roll stands a Fe—Cr—SiNi—C alloy that is called chilled cast iron has been used for more than 40 years. The microstructure of this material has a tempered martensite die with a precipitation of secondary carbides $M_3C$ and interdendritic web of eutectic carbides $M_3C$ (volumetric fraction of approximately 25%), besides lumpy or nodular graphite that also is interdendritic (volumetric fraction of approximately 3%). This microstructure is the resultant of the balance of the characteristics of the alloy elements in the chemical composition: silicon and nickel are graphite producing components, chromium is a strong carbide producing component and, additionally, nickel also determines the hardenability needed to prevent the formation of perlite in the cooling after the casting.

The long useful life of chilled cast iron that are applied to rolls of finishing roll stands is attributed to the fact that its microstructure has represented, until the present date, the best compromising solution between the abrasive wear resistance that is promoted by the die and eutectic carbides, and the adhesion resistance and unstable propagation of microcracks that are promoted by the graphite. It should be understood that the graphite acts as a lubricant in the roll/rolled strip interface (diminishing the adhesion) and decreases the concentration of stress at the end of microcracks, thus diminishing the propagation rate thereof.

A few substantial developments had been carried out in the product line/process of rolls designed to the last roll stands of the hot rolling mill of strips. Among the most expressive according to this same conception of material, that is, the chilled cast iron, we may cite the ones that include additions of alloy elements for the formation of hard second phase particles that only comprise dispersed fine carbides. Changes have also been made to the process of solidification in order to attain more refined structures.

The efforts of the manufacturers to satisfy the demand of the users of such rolls as to a higher abrasive wear resistance, while keeping the other performance characteristics, are based on the use of strong alloy elements that form eutectic and/or secondary carbides harder than carbide $M_3C$, such as, for example, $M_7C_3$ and MC type carbides.

However, it was found that this is counter-productive for promoting a reduction or suppression of the graphite formation and, consequently, diminishing the adhesion resistance and the unstable propagation of microcracks; that is, the resulting compromising solution has not implied an increased productivity of the rolling mill train.

Patent PCT/U51996/09181 discloses a process for the production of chilled cast iron with the addition of between 0.3% and 6% niobium by weight and with a service performance that supersedes that of chilled cast iron. The presence of niobium promotes the formation of isolated particles of primary carbide NbC with an increased hardness, without compromising the graphite formation, thus increasing the abrasive wear resistance and keeping the adhesion resistance and the unstable propagation of microcracks (the formation of carbide NbC takes place at temperatures higher than that of graphite and, therefore, there is no competition between same).

However, the addition of niobium is practically of the order of 0.6%, therefore, higher contents imply the need to substantially increase the pouring temperature while roll is being cast, thus making the process unworkable. With this addition level, the increase of the abrasive wear resistance is limited, since the volumetric fraction of eutectic carbide NbC in the microstructure is limited to values lower than 1%, besides the absence of precipitation of secondary carbide NbC in the die.

In addition to such attempts, only a few rolling mills use multi-component white cast iron in the last roll stands that are obtained either by a centrifugal casting process or a CPC ("continuous pouring cladding" process or, in vernacular language, "coating through continuous casting") However, a problem that such rolling mills face is that the composition of this type of alloy does not contain graphite, thus compromising the adhesion resistance.

BRIEF SUMMARY OF THE INVENTION

Having in mind the prevention of said disadvantages of the state of the art, the process and the product objects of the present invention have been development.

More specifically, the invention is related to the introduction of sulfur, as a linking element, to multi-component white cast iron, for the purpose of forming sulfide phase particles in the microstructure in a controlled way, thus allowing the use of this type of material in the manufacture of rolling mill cast rolls with a high service performance.

DETAILED DESCRIPTION OF THE INVENTION

It is, therefore, the object of the present invention to provide a process for the production of rolling mill cast rolls that are resistant to the adhesion of the rolled strips, as well as resistant to the abrasive wear and the unstable propagation of cracks.

For that purpose, a way to allow the use of alloys of multi-component white cast iron or high chromium white cast iron in the rolls of the last roll stands (finishing roll stands) has been developed, so that the problem of the absence of graphite (lubricating element) could be eliminated.

The conventional steps of a process for producing rolling mill rolls from high chromium white cast iron or multi-component white cast iron are:

a) introduction of waste liquid metal, alloy elements and a lot of scrap into a melting furnace;

b) melting of the load;

c) pouring of the resulting mixture into a foundry ladle;

d) transfer of the content of the foundry ladle to the casting equipment, thus shaping the semi-finished roll.

The present invention comprises, in an innovative way, as seen in FIG. 1, the steps of:

- introduction (1) of waste liquid metal (a), alloy elements (b) and a lot of scrap (c) into a melting furnace;
- melting (2) of the load;
- chemical pre-analysis (3) of a sample (d) of the load in order to correct (4) the chemical composition (through the addition (e) of iron alloys or pure metals);
- addition (5) of sulfur (f) to the load;
- chemical pre-analysis (6) of a new sample (g) of the load in order to correct (7) the chemical composition (h);
- addition (8) of at least one rare earth metal (k) to the foundry ladle (j);
- transfer (9) of the liquid metal (i) from the melting furnace to the foundry ladle (j);
- transfer of the content of the foundry ladle to the casting equipment (10), thus forming the semi-finished roll (11).

The addition of sulfur to the process, combined with at least one rare earth metal, makes it possible to attain a controlled formation of sulfide phase particles in the microstructure, thus unexpectedly obtaining a better resistance to abrasive wear and a better resistance to adhesion and unstable propagation of cracks. This is due to the fact that the elements vanadium, chromium, molybdenum and tungsten that are present in the chemical composition of multi-component white cast iron, and a number of them are present in high chromium white cast iron, induce the formation of eutectic and secondary carbides having an increased hardness between 2000 HV and 2800 HV (wherein "HV" expresses the measure of hardness, that is, "Vickers Hardness"). Thus, this higher abrasive wear resistance of the rolls is promoted by the die and eutectic carbides, and the sulfide phase acts as a substitute to graphite, acting as a lubricant in the roll/rolled strip interface, thus diminishing the possibility of adhesion of the strips, and acting in such a way that it decreases the concentration of stress at the end of cracks, thus diminishing the propagation rate thereof.

The sulfur content is balanced with the manganese content used in the composition (Mn:S ratio=2:1).

The chemical composition of the initial liquid metal may comprise, but not in a limited way, 1.0% to 3.0% carbon, up to 18% chromium, 8.0% molybdenum, 8.0% tungsten, 10% vanadium, 2.0% manganese, and 2.0% silicon. The final composition of the alloy of the roll may also comprise up to 1.0% nickel and 0.08% phosphorus, besides sulfur, whose content added during the process may be from 0.1% to 1.0% by weight.

The addition of the rare earth metal alloy is in a ratio of 0.2% of the weight of the melt in the foundry ladle. The rare earth metal alloy contains, preferably, 50% cerium by weight.

The value of the process temperature depends on the value of the initial load, and may vary between about 1.200° C. and 1.500° C.

Thus, the present invention offers the advantage that the addition of sulfur to the process for the production of rolling mill cast rolls results in rolling mill rolls with a high resistance to the degradation of the surfaces thereof during the use.

Consequently, the addition of sulfur makes it possible to use a lower number of rolls, with a lower need to recover the initial condition of the same, thus allowing for a prolongation of the rolling mill campaign with less shutdowns during the rolling process, as well as a better superficial finishing of the final products.

A table showing examples of preferred embodiments of the chemical composition of the material used to manufacture the shield of the rolling mill cast roll with a higher resistance to the degradation of the present invention is given below:

| Chemical Composition | Alloy A |
|---|---|
| C | 1.5-2.5 |
| Cr | 3.0-10 |
| Mo | 2.0-8.0 |
| W | 2.0-8.0 |
| V | 2.0-10 |
| Mn* | <2.0 |
| Si | <1.0 |
| Ni | <1.0 |
| P | <0.08 |
| S | 0.1-0.8 |
| Fe | q.s.p. |

wherein,

Alloy A = multi-component white cast iron, also known as high-speed steel;

Alloy B = high chromium white cast iron; and q.s.p. = amount sufficient to.

*= The element manganese (Mn) is balanced with the sulfur content for the formation of the sulfide phase.

Although a preferred concept of this solution has been described and illustrated, it should be pointed out that other solutions are susceptible to accomplish without departing from the scope of the present invention. We have examples of this variation at the time the mixture of rare earth metals is added, said addition being preferably made in the bottom of the foundry ladle (j) in order to attain better results, but it also could be carried out directly in the spurt of metal that is being poured, or else conditioned in components of the casting equipment.

Another variation of the present invention is that, besides the centrifugal casting, the same material that was developed (product) could be used in the manufacture of rolls through CPC ("Continuous Pouring Cladding"), already cited previously.

Although the present invention has been described in relation to what is currently deemed to be the more practical preferred embodiment, it should be understood that the invention should not be limited to the abovementioned embodiment, but rather cover several modifications and equivalent arrangements included in the spirit and scope of the attached claims. Therefore, the scope of the attached claims should be in accordance with a wider interpretation in order to encompass all such similar modifications and adjustments.

The invention claimed is:

1. A rolling mill cast roll comprising:

a shield consisting of a multi-component white cast iron, wherein a chemical composition of the multi-component white cast iron consists of 1.5-2.5% carbon, 3.0-10% chromium, 2.0-8.0% molybdenum, 2.0-8.0% tungsten, 2.0-10% vanadium, 0.1-0.8% sulfur, up to 2.0% manganese, up to 1.0% silicon, up to 1.0% nickel, up to 0.08% phosphorus, 0.1% Ce, and a sufficient amount of Fe, wherein the manganese is balanced with said sulfur in a 2:1 ratio (Mn:S).

2. The rolling mill cast roll according to claim 1, wherein the rolling mill cast roll is used in finishing roll stands of rolling processes.

* * * * *